United States Patent [19]

Jones et al.

[11] 4,371,461

[45] Feb. 1, 1983

[54] LIQUID DETERGENT COMPOSITIONS WITH TERTIARY ALCOHOL SKIN FEEL ADDITIVES

[75] Inventors: Keith A. Jones, Fairfield, Ohio; Harry S. Walker, Jr., Bryn Mawr, Pa.

[73] Assignee: The Procter & Gamble Company, Cincinnati, Ohio

[21] Appl. No.: 299,692

[22] Filed: Sep. 8, 1981

Related U.S. Application Data

[63] Continuation-in-part of Ser. No. 193,050, Oct. 2, 1980, abandoned.

[51] Int. Cl.[3] ..... C11D 3/20; C11D 3/46; C11D 3/48; C11D 17/08

[52] U.S. Cl. ..... 252/547; 252/89.1; 252/153; 252/162; 252/173; 252/174.11; 252/174.21; 252/548; 252/550; 252/551; 252/DIG. 5; 252/DIG. 13; 252/DIG. 14; 424/343

[58] Field of Search ..... 424/343; 252/89.1, 106, 252/107, 132, 153, 162, 173, 174.11, 174.21, 541, 545, 547, 548, DIG. 5, DIG. 13, DIG. 14

[56] References Cited

U.S. PATENT DOCUMENTS

| | | | |
|---|---|---|---|
| 2,925,363 | 2/1960 | Bavley | 424/343 |
| 3,367,878 | 2/1968 | Mankowich | 252/165 |
| 3,402,209 | 9/1968 | Gilbert | 424/343 |
| 3,878,200 | 2/1974 | Diana | 424/343 |
| 3,907,908 | 9/1975 | Light et al. | 252/174.11 |
| 3,939,760 | 11/1976 | Light et al. | 252/174.11 |
| 3,966,649 | 6/1976 | Cheng | 252/542 |
| 3,991,123 | 2/1976 | Mookherjee et al. | 252/174.11 |
| 3,998,750 | 12/1976 | Payne et al. | 252/108 |
| 4,041,084 | 8/1977 | Light et al. | 252/174.11 |

FOREIGN PATENT DOCUMENTS

| | | | |
|---|---|---|---|
| 50-7769415 | 5/1975 | Japan . | |
| 640373 | 7/1950 | United Kingdom | 252/DIG. 14 |
| 1201716 | 8/1970 | United Kingdom . | |

*Primary Examiner*—Dennis L. Albrecht

*Attorney, Agent, or Firm*—Donald E. Hasse; Robert B. Aylor; Thomas H. O'Flaherty

[57] ABSTRACT

Liquid detergent compositions with improved skin benefit comprising from about 0.1% to about 0.6% of a $C_{8-20}$ tertiary alcohol.

8 Claims, No Drawings

LIQUID DETERGENT COMPOSITIONS WITH TERTIARY ALCOHOL SKIN FEEL ADDITIVES

CROSS REFERENCE OF RELATED APPLICATION

This is a continuation-in-part of our copending U.S. patent application Ser. No. 193,050 filed Oct. 2, 1980, now abandoned, for Liquid Detergent Composition.

BACKGROUND

The invention relates to mild liquid detergent compositions especially useful in the washing of tableware, kitchenware and other hard surfaces.

SUMMARY OF THE INVENTION

The present invention comprises a liquid detergent composition containing by weight:

(a) from about 10% to about 50% of a detergent surfactant;

(b) from 0% to about 15% of a suds stabilizing nonionic surfactant selected from the group consisting of amine oxides, fatty acid amides, and the ethylene oxide condensates of alcohols and alkyl phenols;

(c) from about 0.01% to about 0.6% of a tertiary alcohol containing from about 8 to about 20 carbon atoms; and (d) balance water and alcohol said composition being essentially free of aldehydes and primary alcohols with structures like said tertiary alcohol and having a pH in use of less than about 8.5. The tertiary alcohol provides a skin benefit which is noticeable and desirable to a majority of consumers.

DETAILED DESCRIPTION OF THE INVENTION

The detergent compositions of the present invention contain three essential components:

(a) a surfactant;

(b) the tertiary alcohol; and (c) water.

Optional ingredients can be added to provide various performance and aesthetic characteristics.

Surfactant

The compositions of this invention contain from about 10% to about 50% of a detergent surfactant or mixtures thereof. Preferred compositions for use as a complete dishwashing product contain from about 20% to about 35% of surfactant by weight of the composition.

Preferred anionic detergents which can be broadly described as the water-soluble salts, particularly the alkali metal, alkaline earth metal, ammonium and amine salts, of organic sulfuric reaction products having in their molecular structure an alkyl radical containing from about 8 to about 22 carbon atoms and a radical selected from the group consisting of sulfonic acid and sulfuric acid ester radicals. Included in the term alkyl is the alkyl portion of higher acyl radicals. Examples of the anionic synthetic detergents which can form the surfactant component of the compositions of the present invention are the sodium, ammonium, or potassium alkyl sulfates, especially those obtained by sulfating the higher alcohols ($C_8$–$C_{18}$ carbon atoms) sodium or potassium alkylbenzene or alkyltoluene sulfonates, in which the alkyl group contains from about 9 to about 15 carbon atoms, the alkyl radical being either a straight or branched aliphatic chain; sodium or potassium paraffin sulfonates and olefin sulfonates in which the alkyl or alkenyl group contains from about 10 to about 20 carbon atoms; sodium alkyl glyceryl ether sulfonates, especially those ethers of the higher alcohols derived from tallow and coconut oil; sodium coconut oil fatty acid monoglyceride sulfates and sulfonates; sodium or potassium salts of alkyl phenol ethylene oxide ether sulfates with about 1 to about 30 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium beta-acetoxy or beta-acetamido alkane sulfonates where the alkane has from 8 to 22 carbon atoms.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate, magnesium $C_{12-15}$ alkyl sulfate and mixtures of these surfactants. Preferred alkyl sulfates include sodium coconut alkyl sulfate, potassium coconut alkyl sulfate, potassium lauryl alkyl sulfate and sodium lauryl alkyl sulfate.

Suitable alkylbenzene or alkyltoluene sulfonates include the alkali metal (lithium, sodium, potassium), alkaline earth (calcium, magnesium) and alkanolamine salts of straight or branched-chain alkylbenzene or alkyltoluene sulfonic acids. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid. Preferred sulfonic acids as precursors of the alkylbenzene sulfonates useful for compositions herein are those in which the alkyl chain is linear and averages about 12 carbon atoms in length. Examples of commercially available alkylbenzene sulfonic acids useful in the present invention include Conoco SA 515 and SA597 marketed by the Continental Oil Company and Calsoft LAS 99 marketed by the Pilot Chemical Company.

Particularly preferred anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having from about 10 to about 20 carbon atoms. Preferably, R has 10 to 16 carbon atoms. The alcohols can be derived from natural fats, e.g., coconut oil or tallow, or can be synthetic. Such alchols are reacted with 1 to 30, and especially 1 to 12, molar proportions of ethylene oxide and the resulting mixture of molecular species is sulfated and neutralized.

Specific examples of alkyl ether sulfates of the present invention are sodium coconut alkyl triethylene glycol ether sulfate, magnesium tallow alkyl triethylene glycol ether sulfate, and sodium tallow alkyl hexaoxyethylene sulfate. Preferred alkyl ether sulfates are those comprising a mixture of individual compounds, said mixture having an average alkyl chain length of from about 12 to 16 carbon atoms and an average degree of ethoxylation of from about 1 to 12 moles of ethylene oxide.

Additional examples of anionic surfactants useful herein are the compounds which contain two anionic functional groups. These are referred to as dianionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acylic aliphatic hydrocarbyl group having 15 to 20 carbon atoms and M is a water-solubizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

The compositions of this invention can also contain up to about 15%, preferably from about 3% to about 8% of a suds stabilizing nonionic surfactant or mixtures thereof. The presence of this component is essential to satisfactory performance and acceptance as a complete dishwashing product. In preferred embodiments the nonionic surfactants will be in a weight ratio to the anionic surfactants of from about 1:10 to about 1:2, most preferably from about 1:7 to about 1:3.

Nonionic surfactants operable in the instant compositions are of three basic types-the ethylene oxide condensates, the amides, and the amine oxide semi-polar nonionics.

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of such ethylene oxide condensates include:

(1) The condensation products of aliphatic alcohols with ethylene oxide. The alkyl chain of the aliphatic alcohol can either be straight or branched and generally contains from about 10 to about 14 carbon atoms for best performance as suds stabilizers. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. An example of a commercially available nonionic surfactant of this type includes Neodol 23-6.5 marketed by the Shell Chemical Company.

(2) The ethylene oxide condensates of alkyl phenols. These compounds include the condensation products of alkyl phenols having an alkyl group containing from about 6 to 12 carbon atoms in either a straight chain or branched chain configuration, with ethylene oxide, the ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, diisooctylphenol condensed with about 15 moles of ethylene oxides per mole of phenol. Commercially available nonionic surfactants of this type include Igepal CO-610 marketed by the GAF Corporation; and Triton X-45, X-114, X-100, and X-102, all marketed by Rohm & Haas Company.

Examples of the amide type of nonionic surface active agent include the ammonia, monoethanol, and diethanol amides of fatty acids having an acyl moiety of from about 8 to about 18 carbon atoms. These acyl moieties may be derived from naturally-occurring glycerides, e.g., coconut oil, palm oil, soybean oil and tallow, but can be derived synthetically, e.g., by the oxidation of petroleum, or by hydrogenation of carbon monoxide by the Fischer-Tropsch process. The monoethanolamides and diethanolamides of $C_{12-14}$ fatty acids are preferred.

Amine oxide semipolar nonionic surface active agents comprise compounds and mixtures of compounds having the formula:

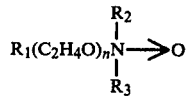

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms; $R_2$ and $R_3$ are each selected from the group consisting of methyl, ethyl, hydroxymethyl, propyl, 2-hydroxyethyl, 2-hydroxypropyl, and 3-hydroxypropyl and mixtures thereof; and n is from 0 to about 10. Particularly preferred are amine oxides of the formula:

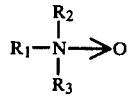

wherein $R_1$ is a $C_{10-14}$ alkyl and $R_2$ and $R_3$ are methyl or ethyl.

The level and type of surfactants used in the compositions of this invention desirably provide an initial suds cover to a dishwashing solution and a suds cover after the washing of eight plates when used at a concentration of 0.07% in two gallons of 115° F. water containing 7 grains/gallon water hardness measured as $CaCO_3$, each plate carrying 4.0 ml. of a triglyceride containing soil. Suds are generated by agitation and the suds cover and height measured. A dinner plate carrying the soil is washed successively with the introduction of 4.0 ml. of soil each time. Preferably, the suds cover after the washing of eight plates is at least about ½ inch in height.

The sudsing characteristic of the compositions of the invention provides the user of the product with an indication of cleaning potential in a dishwashing solution. Soils encountered in dishwashing act as suds depressants and the presence or absence of suds from the surface of a dishwashing solution is a convenient guide to product usage. Mixtures of anionic surfactants and nonionic surfactants, especially amides and amine oxide nonionic surfactants, are preferably utilized in the compositions of the invention because of their high sudsing characteristics, their suds stability in the presence of food soils and their ability to indicate accurately an adequate level of product usage in the presence of soil.

The compositions of the invention may contain surfactants other than anionic and nonionic surfactants such as ampholytic, zwitterionic, and cationic surfactants.

Ampholytic surfactants can be broadly described as derivatives of aliphatic amines which contain a long chain of about 8 to 18 carbon atoms and an anionic water-solubilizing group, e.g., carboxy, sulfo, or sulfate. Examples of compounds falling within this definition are sodium-3-dodecylaminopropane sulfonate, and dodecyldimethylammonium hexanoate.

Zwitterionic surface active agents operable in the instant composition are broadly described as internally-neutralized derivatives of aliphatic quaternary ammonium and phosphonium and tertiary sulfonium compounds in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono.

Cationic surfactants such as quaternary ammonium compounds can find optional use in the practice of the invention to the extent they are compatible with the other surfactants in the particular composition.

The Tertiary Alcohol

The tertiary alcohol is present in the detergent compositions at a level of from about 0.01% to about 0.6%, preferably from about 0.05% to about 0.3%, most preferably from about 0.07% to about 0.2%. Under normal usage these concentrations give levels of from about 0.01 to about 30 ppm, preferably from about 0.05 to about 15 ppm in the wash solution. The preferred alcohols are linalool, tetrahydrolinalool, 4-terpineol, Aprol-100 (3,6-dimethyl octane-3-ol), alpha-terpineol, ocimenol and nerolidol.

The skin feel benefit is apparently perceived in different ways by people, but is usually described in terms of improved mildness, smoothness, etc. At higher levels the skin feel is seen as being less desirable so that it is important to avoid excessive concentrations. A level of at least about 0.02% however, is needed to provide the benefit at a practical level. The health of the skin and associated structures such as hair is believed to be benefited.

Alcohols having less carbon atoms such as tertiary butyl alcohol do not provide the benefit. It is also important to minimize aldehydes and primary alcohols in perfumes used in this invention since they tend to block the skin benefit effect.

Water

The compositions of this invention contain the balance, preferably from about 40% to about 75%, water.

pH

It has been determined that at pH's of greater than about 8.5 in the washing solution, the skin feel benefit is not seen due to the "soapy" feeling of the solution. pH's in the wash solution of from about 5 to about 8.5, preferably from about 5.5 to about 8 are desirable. Buffering agents can be added to ensure that the wash solution has the desired pH. Typical use concentrations are from about 0.1% to about 1%. pH should be measured at the median concentration of about 0.2%.

Optional Ingredients

The compositions of this invention can contain up to about 20%, preferably from about 5% to about 15%, by weight of detergency builders either of the organic or inorganic types. Examples of water-soluble inorganic builders which can be used, alone or in admixture with themselves and organic alkaline sequestrant builder salts. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other or with the preceding inorganic alkaline builder salts, are alkali metal polycarboxylates, e.g., water-soluble citrates such as sodium and potassium citrate, sodium and potassium tartrate, sodium and potassium ethylenediaminetetraacetate, triacetates, sodium and potassium N-2-(hydroxyethyl)ethylenediaminetriacetates, sodium and potassium nitrilotriacetates (NTA), and sodium and potassium N-(2-hydroxyethyl)nitrilodiacetates. Other organic builder salts include the alkali metal salts of phytic acid, e.g., sodium phytate (see U.S. Pat. No. 2,739,942). Water-soluble salts of ethane-1-hydroxy-1,1-diphosphonate (EHDP) are also available. Mixtures of any of the preceding water-soluble organic or inorganic builder salts can be used.

The compositions of this invention can contain insoluble builder salts selected from certain zeolites or aluminosilicates. One such aluminosilicate which is useful in the compositions of the invention is water-insoluble crystalline aluminosilicate ion exchange material of the formula:

$$Na_z[(AlO_2)_z.(SiO_2)_y].xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$eq./gram and a calcium ion exchange rate of at least about 2 grains $Ca^{++}$/gallon/minute/gram. This ion exchange builder is more fully described in Belgian Pat. No. 814,874 issued on Nov. 11, 1974 to Corkill et al, herein incorporated by reference. A preferred aluminosilicate of this type is Zeolite A.

A second water-insoluble aluminosilicate ion exchange material useful herein is water-insoluble amorphous hydrated aluminosilicate material of the empirical formula:

$M_z(zAlO_2.ySiO_2)$ wherein M is sodium, potassium, ammonium, or substituted ammonium, z is from about 0.5 to about 2, y is 1 and said material having a particle size diameter of less than 100, preferably less than 10 microns, a magnesium ion exchange capacity of at least about 50 milligrams equivalent of $CaCO_3$ hardness per gram of anhydrous aluminosilicate and a $Mg^{++}$ exchange rate of at least about 1 grain/gallon/minute/gram/gallon; and mixtures thereof. This ion exchange builder is more fully described in Gedge et al's French Pat. No. 2,237,839 published Feb. 14, 1975, herein incorporated by reference.

Alcohols, such as ethyl alcohol, and hydrotypes, such as sodium and potassium toluene sulfonate, sodium and potassium xylene sulfonate, trisodium sulfosuccinate and related compounds (as disclosed in U.S. Pat. No. 3,915,903, incorporated herein by reference) and urea, can be utilized in the interests of achieving a desired product phase stability, viscosity, and yield value. Ethyl alcohol at a level of from about 8% to about 12% and potassium or sodium sulfosuccinate at a level of from about 2% to about 5% are particularly useful in the compositions of the invention.

Also useful in the compositions of this invention are suspending or thickening agents such as those disclosed in U.S. Pat. No. 3,393,153 incorporated herein by reference including colloidal silica having a mean particle diameter ranging from about 0.01 micron to about 0.05 micron, colloidal clays such as bentonites or chemically treated bentonites, isomorphous silicates, especially those with a high magnesium content, particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples of suspending and thickening agents include copolymers of styrene with monomers such as maleic anhydride, nitrilonitrile, methacrylic acid and lower alkyl esters of methacrylic acid, copolymers of styrene with methyl or ethyl acrylate, methyl or ethyl maleate, vinyl acetate, acrylic, maleic, or fumaric acids and mixtures thereof. The mole ratio of ester and/or acid to styrene is preferably in the range from about 4 too about 40 styrene units per ester and/or acid unit. Such materials preferably have a mean particle diameter range of from about 0.05 micron to about 1 micron and molecular weights ranging from about 500,000 to about 2,000,000. Cellulosic polymers such as carboxymethyl cellulose and hydroxypropyl cellulose and gums such as guar gum and gum tragacanth are also suitable suspending and thickening agents.

Colloidal clays are especially preferred suspending and thickening agents and provide particularly stable compositions when product pH is maintained or adjusted to a range of from about 8.0 to about 10.0. An alkaline pH value has an additional benefit as an aid to cleaning, but the pH in the cleaning solution should not exceed about 8.5.

The detergent compositions of this invention can contain, if desired, any of the usual adjuvants, diluents and additives, for example, perfumes, enzymes, dyes, antitarnishing agents, antimicrobial agents, abrasives, and the like, without detracting from the advantageous properties of the compositions. Alkalinity sources and pH buffering agents such as alkali metal carbonates and bicarbonates, monoethanolamine, triethanolamine, and alkali metal hydroxides can also be utilized.

The detergent compositions of this invention can contain, if desired, any of the usual adjuvants, diluents and additives, for example, perfumes, enzymes, dyes, antitarnishing agents, antimicrobial agents, abrasives, and the like, without detracting from the advantageous properties of the compositions. Alkalinity sources and pH buffering agents such as alkali metal carbonates and bicarbonates, monoethanolamine, triethanolamine, and alkali metal hydroxides can also be utilized.

The presence of at least about 0.5% by weight potassium ions can be beneficial to the physical characteristics of the compositions.

The following examples are given to illustrate the detergent compositions of the invention. All amounts and percentages are by weight unless otherwise indicated.

EXAMPLES

Liquid detergent compositions of the invention are prepared containing the ingredients listed below:

EXAMPLE I

| | A | B | C | D | E | F | G |
|---|---|---|---|---|---|---|---|
| Ammonium $C_{12-13}$ alkyl sulfate | 6.5% | 6.5% | 6.5% | 6.5% | 6.5% | 6.5% | 6.5% |
| Ammonium $C_{12-13}$ alkyl ethoxy(12) sulfate | 18.8 | 18.8 | 18.8 | 18.8 | 18.8 | 18.8 | 18.8 |
| Ammonium $C_{12-14}$ alkyl monoglyceryl ether sulfate | 4.0 | 4.0 | 4.0 | 4.0 | 4.0 | 4.0 | 4.0 |
| $C_{12-14}$ alkyl dimethylamine oxide | 5.0 | 5.0 | 5.0 | 5.0 | 5.0 | 5.0 | 5.0 |
| Potassium toluene sulfonate | 0.5 | 0.5 | 0.5 | 0.5 | 0.5 | 0.5 | 0.5 |
| Linaolool | 0.1 | — | — | — | — | — | — |
| Tetrahydrolinalool | — | 0.1 | — | — | — | — | — |
| 4-Terpineol | — | — | 0.1 | — | — | — | — |
| alpha-Terpineol | — | — | — | 0.1 | — | — | — |
| Ocimenol | — | — | — | — | 0.1 | — | — |
| Nerolidol | — | — | — | — | — | 0.1 | — |
| Aprol-100 | — | — | — | — | — | — | 0.1 |
| Ethanol | 8.0 | 8.0 | 8.0 | 8.0 | 8.0 | 8.0 | 8.0 |
| Water and miscellaneous | Miscellaneous | | | | | | |

The compositions are entirely satisfactory when used in dilute solutions as dishwashing detergent compositions and are substantially superior to skin feel to the same composition without the tertiary alcohol. When individuals placed their hands in wash solutions containing artifical soil and the above liquid detergent compositions at the individuals' normal usage level, the preferences for the above formulas as compared to the base formula were as follows:

| A | B | C | D | E | F | G |
|---|---|---|---|---|---|---|
| 58/42 | 60/40 | 58/42 | 54/46 | 56/44 | 57/43 | 56/44 |

A similar composition containing 1% linaolool was less preferred than the base product 39/61.

Equivalent results are obtained when $C_{12}$ alkyldiethanol amide, $C_{12}$ alkylmonoethanol amide and the reaction product of a $C_{12-15}$ alcohol and 8 moles of ethylene oxide are substituted for the amine oxides of Compositions A–E.

Equivalent results are obtained when sodium $C_{12-13}$ alkylbenzene sulfonate and $C_{12-15}$ paraffin sulfonate are substituted for the sodium $C_{12-13}$ alkyl sulfate of compositions A, B, C, D, and E.

EXAMPLE II

Formula A of Example I was modified with standard buffering agents to the indicated pHs. Eight expert panelists felt the wash solutions (~0.2%). The same expert panelists felt water buffered to the same pH's with the indicated results. At pH's above about 8.5, there was a noticeable slippery, "soapy" feel which totally replaced the "normal" linalool feel benefit.

| pH | Formula A Noticed Skin Feel Benefit | Noticed "Soapy" Feel in Buffered Water |
|---|---|---|
| 7.0 | 8 | 0 |
| 7.5 | 8 | 0 |
| 8.0 | 8 | 0 |
| 8.5 | 8 | 3 |
| 9.0 | 0 | 3 |
| 9.5 | 0 | — |
| 10.0 | 0 | 2 |

What is claimed is:

1. A liquid detergent composition containing by weight:
   (a) from about 10% to about 50% of a detergent surfactant;
   (b) from 0% to about 15% of a suds stabilizing nonionic surfactant selected from the group consisting of amine oxides, fatty acid amides, and the ethylene oxide condensates of alcohols and alkyl phenols;
   (c) from about 0.01% to about 0.6% of linalool; and
   (d) balance water and alcohol said composition being essentially free of aldehydes and primary alcohols with structures like linalool and having a pH in use of less than about 8.5.

2. The composition of claim 1 wherein the linalool is present at a level of from about 0.05% to about 0.3%.

3. The composition of claim 1 wherein the linalool is present at a level of from about 0.07% to about 0.2%.

4. The composition of claim 1 wherein the surfactant is present at a level of from about 20 to about 35%.

5. The composition of claim 1 containing from about 3% to about 8% of the suds stabilizer.

6. The composition of claim 4 or 5 wherein the linalool is present at a level of from about 0.05% to about 0.3%.

7. The composition of claim 4 or 5 wherein the linalool is present at a level of from about 0.07% to about 0.2%.

8. A process of hand washing dishes in wash water containing from about 0.1 to about 30 ppm of linalool.

* * * * *